United States Patent [19]

Strong et al.

[11] 4,440,002

[45] Apr. 3, 1984

[54] VARIABLE DRAW MECHANISM FOR STRAIGHT BAR KNITTING MACHINES

[75] Inventors: Barry C. Strong, Syston; Herbert Brain, Wymeswold, both of England

[73] Assignee: William Cotton Limited, Leicestershire, England

[21] Appl. No.: 407,507

[22] Filed: Aug. 12, 1982

[30] Foreign Application Priority Data

Aug. 14, 1981 [GB] United Kingdom ..... 8124681

[51] Int. Cl.[3] ..... D04B 15/52

[52] U.S. Cl. ..... 66/126 R; 66/130

[58] Field of Search ..... 66/126, 130, 127, 128, 66/110

[56] References Cited

U.S. PATENT DOCUMENTS

| | | | |
|---|---|---|---|
| 2,872,798 | 2/1959 | Matthews et al. | 66/110 |
| 3,563,062 | 2/1971 | West et al. | 66/126 R |
| 3,575,017 | 4/1971 | Swanwick et al. | 66/126 R |
| 3,623,342 | 11/1971 | Blood et al. | 66/126 R |
| 4,321,807 | 3/1982 | Strong | 66/126 R |

*Primary Examiner*—Ronald Feldbaum

*Attorney, Agent, or Firm*—McCormick, Paulding & Huber

[57] ABSTRACT

A straight bar knitting machine has a variable draw mechanism including a draw cam, means following the draw cam, a first differential input member, means for varying the ratio with which movement of the draw cam following means is transmitted to the first differential input member, a second differential input member and means for controlling the movement of the second input member so as to provide a lead of the carrier in each direction of carrier traverse. The control means include a cam mounting movable conjointly with the first differential input member, cams on the mounting of fixed throw, means for moving the cams in step with the means for varying the transmission ratio to the first differential input member and cam follower means for engaging the cams and connected to second differential input member so as to ensure that the fixed throw establishes the desired extent of carrier lead at the end of each traverse at varying draw widths.

7 Claims, 12 Drawing Figures

VARIABLE DRAW MECHANISM FOR STRAIGHT BAR KNITTING MACHINES

DESCRIPTION

1. Field of invention

The invention relates to variable draw mechanisms for straight bar knitting machines and to knitting machines incorporating such a mechanism. The invention is particularly applicable to high speed straight bar knitting machines of the general type described in the British Patent Specification No. 2015039.

2. Background of invention

Variable draw mechanisms are known. As the traverse of the draw is lengthened or shortened by varying the drive geometry of the variable draw mechanism to comply with the variation in knitting width, the speed of cam shaft rotation is varied to maintain the maximum permissible linear carrier velocity. Quality of knitting is maintained whilst productivity is improved.

A first form of variable draw mechanism, described in the U.S. Patent Specification No. 2,872,798 utilizes the conventional friction box. The throw of a draw cam is transmitted at varying ratios to the slurcock and the friction box. End stops are moved to halt the carriers at the desired stage of the draw and ensure that the halted carrier again moves in advance of the slurcock (i.e. leads) during the next traverse. The British Patent Specification No. 2,015,039 describes a variable draw mechanism which does not utilize a friction box but drives both carrier and slurcock positively through a differential drive mechanism. A cross type cam is provided to alter the timing of the differential drive which ensures the proper carrier lead over the slurcock during each traverse. Such an arrangement may be expensive and requires considerable maintenance.

It is the object of the invention provide a reliable variable draw mechanism in which carriers and slurcock are positively driven through a differential.

SUMMARY OF INVENTION

The invention provides a straight bar knitting machine having a variable draw mechanism for moving a slurcock and yarn carrier to and fro which mechanism includes: a draw cam, means for following the draw cam, a first input member for providing a first input for a gear arrangement, means for varying the ratio of transmission of the draw cam follower movement to the first input member to vary the draw width; a second input member for providing a second input for the gear arrangement, said gear arrangement including a differential for combining the first and second inputs to differentiate slurcock and yarn carrier movement, and means for controlling the second input so as to cause the carrier to lead the slurcock in each direction of draw movement; which control means includes a cam mounting movable conjointly with the first input, lead control cam means mounted on and movable bodily with the mounting, means for moving the cam means individually with respect to the mounting in step with the transmission ratio between draw cam follower means and the first input member and a lead control cam follower means for engaging the cams appropriately and connected to the second input member to retard the yarn carrier and establish a desired carrier lead for a subsequent draw movement at varying draw widths. The lead control cam means have a fixed throw and can be used to establish the desired carrier slow down and lead reversal at the end of a traverse at a wide range of draw widths. The fixed throw cams are operated by the varied movement of the first differential input member in such a way as to give the desired motion to the second differential input member. The variable draw mechanism can be made rugged and reliable so as to permit prolonged high speed operation.

Suitably the first differential input member is pivotable and has a first gear segment for drivingly engaging a gear of the differential. The first input member may be connected to a second gear segment drivingly engaging a rack to move the lead control cam mounting linearly. Such a differential operation causes variations in speed without distortion to the differential and the lead control cam means, thus permitting accurate synchronisation of slurcock and carrier movement. Advantageously the means for following the draw cam are linked to a block on a screw in a pendulum control lever, the screw being turned in proportion to the draw width required, and the block is connected to and carried slidably in a slot in a member carried by a pair of parallel arms, and the first differential input member is a lever pivotable conjointly with the parallel arms. The screw in the pendulum control lever can be turned in proportion to the screw which shifts the carrier end stops throughout the available range of draw widths. It is not necessary to compensate, by an extra mechanism, for a non-linear response of the first differential input member to changes in the end stop position.

Conveniently the lead control cam mounting includes a pair of screws and cam blocks on each of the screws, the arrangement being that the pair of screws turn conjointly to move the cam blocks in opposite senses. The pair of screws may be drivingly connected to a splined shaft which is rotated conjointly with the screw in the pendulum control lever to impart a proportional linear displacement of the cam blocks relative to each other. Suitably the cam follower describes one rocking motion at the end of each traverse, being provided with one arm for engaging each of the cam blocks and changeover means are provided for putting the appropriate arm with the appropriate cam block at the end of each traverse. The change over means is a means for shifting the cam follower axially, the shifting means being operated by a cam movable conjointly with the draw cam. The screws, cam blocks and changeover means permit the cam follower to be pivoted at the end of each traverse and then to be held positively in position by a linear cam track until the changeover means becomes next operative.

DRAWINGS

BEST MODE

Figure 1:
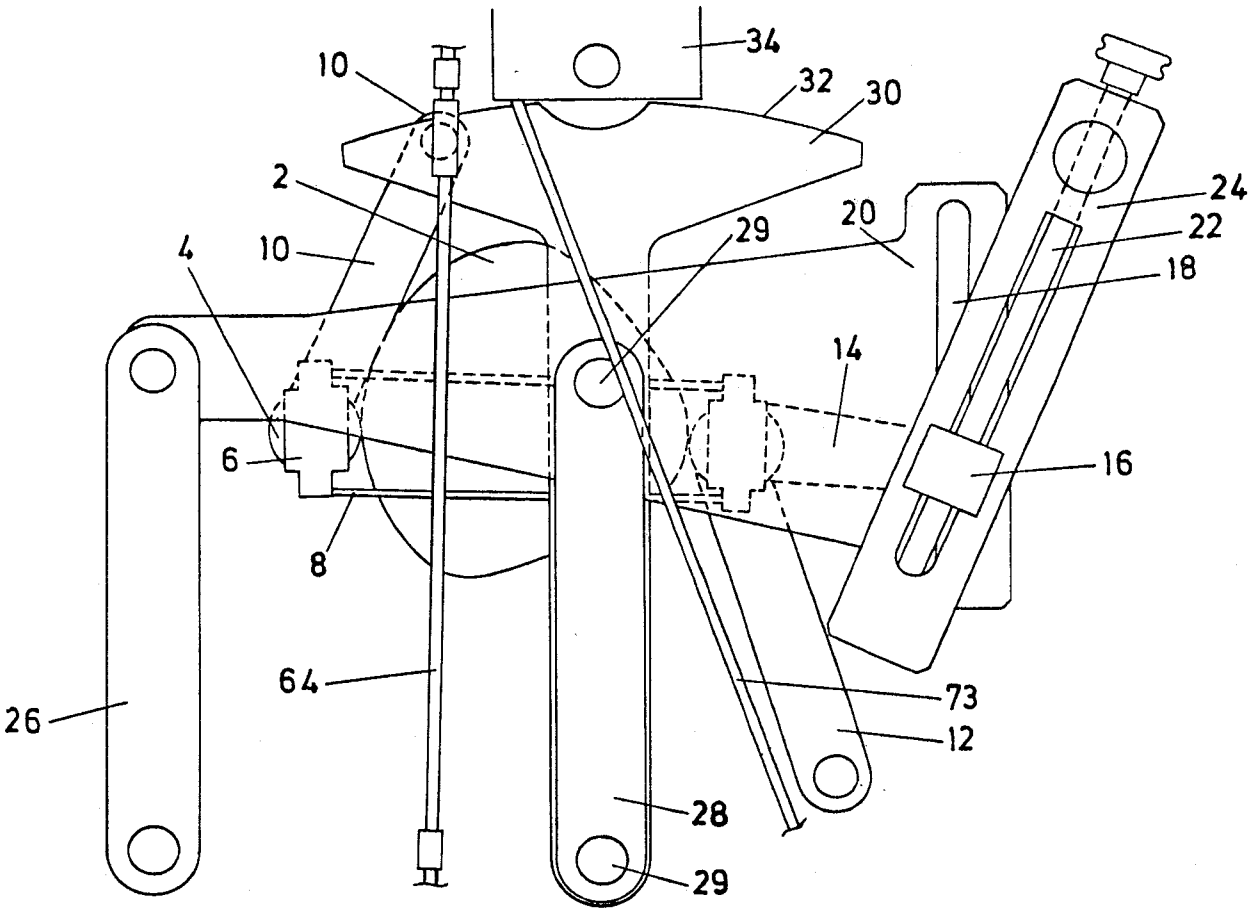
FIG. 1 shows schematically a side view of the principal parts of a variable draw mechanism according to the invention for providing a first differential input.
Figure 2:
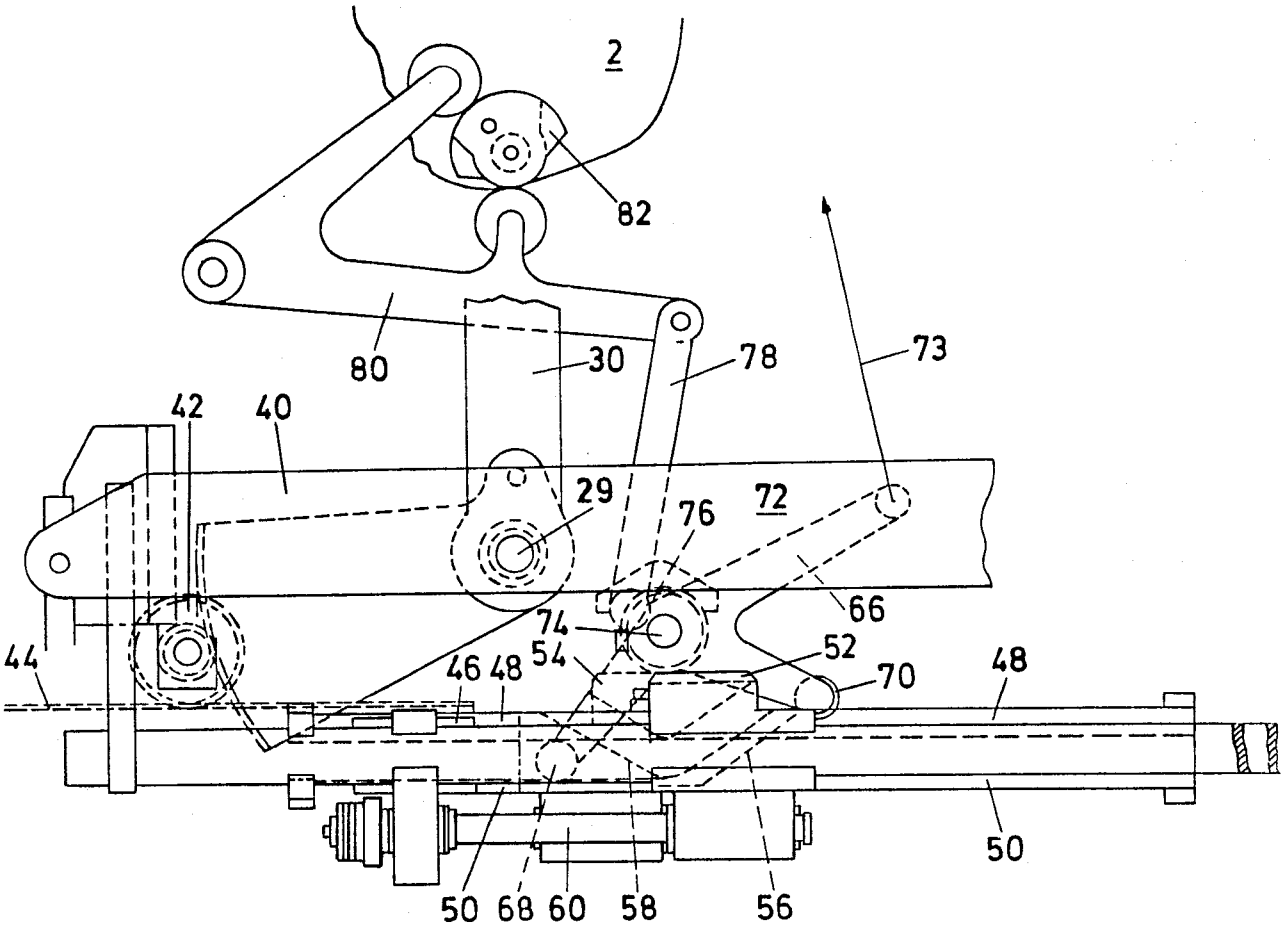
FIG. 2 shows schematically a side view of the principal parts of the variable draw mechanism according to the invention for providing a second differential input.
Figure 3:
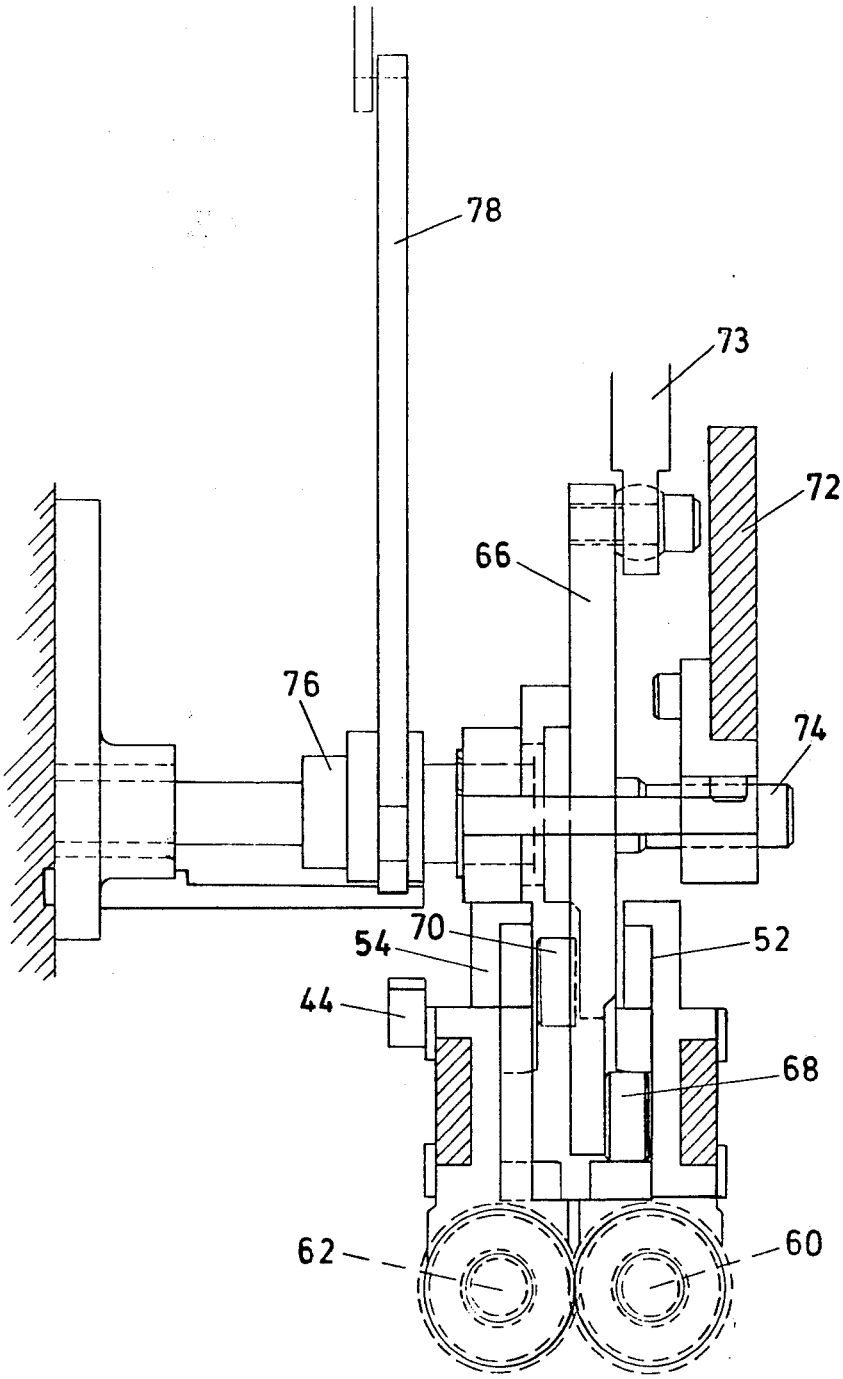
FIG. 3 is a section through the parts shown in FIG. 2.
Figure 10:
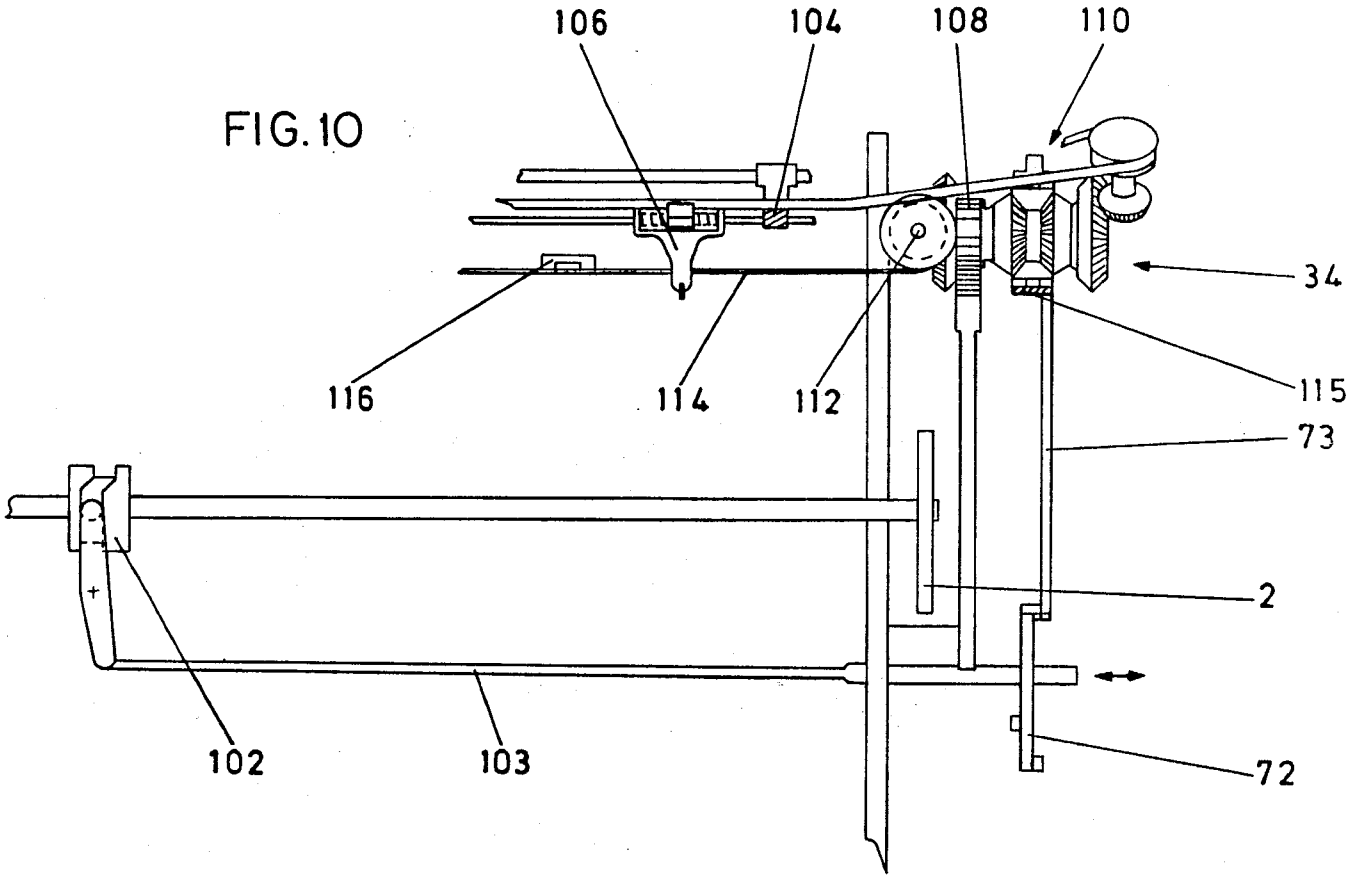
FIG. 10 shows schematically a front view of part of a straight bar knitting machine incorporating the draw mechanism of FIGS. 4 to 9.

With reference mainly to FIGS. 1 to 3, a draw cam 2 is rotated by a half-speed shaft so that the cam 2 rotates once for every two full revolutions of the main cam shaft, each of which provides a knitting and a draw cycle. A draw cam following arrangement includes a pair of rollers 4 arranged on diametrically opposite sides of the cam 2 which are on mountings 6 interconnected by rods 8. A set of rods is provided on each side of the cam 2. The cam following arrangement is supported on one side by a depending pendulum lever 10 and on the other side by an upstanding lever 12 both of which are mounted on a side standard of the straight bar knitting machine. The cam following arrangement is connected by a generally horizontal link 14 to a block 16 located in an upright slot 18 on an A-member 20. The lever 10 has two interconnected members straddling the A-member 20, the rearmost member of the lever being connected to the link 14. The position of the block 16 in the slot 18, and thereby the ratio at which movement is transmitted from the cam following arrangement to the A-member 20, can be controlled by traversing the block along a screw 22 by rotating the screw which is supported in another pendulum lever 24 also mounted on the end standard of the machine. The A-member 20 is supported by two parallel arms 26 and 28. One arm 28 is pivotable about the same axis 29 as a quadrant 30 to which it is connected by pin 29. The quadrant 30 is thus moved conjointly with the arm 28. The quadrant teeth at 32 provide a first differential input to a gear arrangement which includes a differential 34 and is constructed as described in the British Patent Specification No. 2,015,039. The first input is directly connected to a slurcock drive arrangement and varies the extent of slurcock motion in response to the rotation of the screw 22 (see FIG. 10).

With reference now particularly to FIGS. 2 and 3, the quadrant 30 mounts at the bottom a gear segment 40 which in turn meshes with a gear 42 engaging a rack 44. The rack 44 slides backwards and forwards linearly with the same variation as is transmitted through the differential 34 to the slurcock.

The rack 44 carries a cam mounting 46 slidably carried on guide rails 51 and 53 (see FIG. 3). The cam mounting 46 rotatably mounts a pair of screws 60 and 62. Each screw also supports a set of upper and lower track bars 48 and 50 and cam blocks 52 and 54 respectively with facing, oppositely inclined lead control cam surfaces 56 and 58 of fixed throw (see FIG. 3). The cam surfaces 56 and 58 form ramps. The blocks 52 and 54 are threaded for traversing together with the associated track bars 48 and 50 on screws 60 and 62 and are guided for sliding movement and held against rotation by the rails 51 and 53. The screws 60 and 62 are turned by a rod 64 (FIG. 1) so that the screws turn at the same time and to the same extent as the screw 22. Both rod 64 and the screw 22 are driven in step with a selvedge screw 121 on the machine (shown in FIG. 10) which moves end stops for abutting the carriers at the end of their traverse. Chains etc. (see chain 120 in FIGS. 4 to 9) may be used to transmit motion from the selvedge screw to the rod 64 and screw 22 as appropriate. The screws 60 and 62 have meshing gears (see gears 122 in FIG. 11) and act in opposite senses. Thus the lead control cam surfaces 56, 58 are moved linearly in opposite directions as the draw width is increased or decreased. The linear travel of the mounting between engagement of the cam follower lever with the respective cam surfaces changes in proportion to the draw width.

A lead control cam follower is in the form of a lever 72 for engaging the cam surfaces 56 and 58. It has two rollers 68 and 70 facing in opposite directions and an output arm 66 connected to a rod 73 for providing a second differential input to the differential 34. The lever 72 is pivoted in a pivot shaft 74. A screw member 76 engages the lever 6 to shift it axially on the shaft 74 to place the appropriate follower 68 and 70 in the path of the appropriate cam surface 56 or 58. The screw member 76 is operable by a rod 78 and bell crank lever 80 which follows a conjugate cam 82 on the half speed shaft. Consequently the lever 72 is shifted at the end of each draw during the period that knitting is in progress and the slurcock is at rest. In a modified construction shown in FIGS. 4 to 10 a quadrant 30 is operated by a variable transmission ratio mechanism similar to that described previously, but for constructional convenience, the pendulum lever 24 is arranged on the other side. The quadrant operates a gear arrangement including a differential 34 for operating a slurcock and carrier in a similar manner. The quadrant 30 also includes the segment for reciprocating the cam mounting. The main difference is that the lead control cam follower is moved axially by a shogging cam 102 through a follower and a rod 103 passing through the side frame of the straight bar knitting machine, considerably simplifying the mechanism for controlling the axial follower movement. The screws 60 and 62 are turned oppositely by a splined shaft 63 connected by bevel gears to the rod 64.

Figure 4:
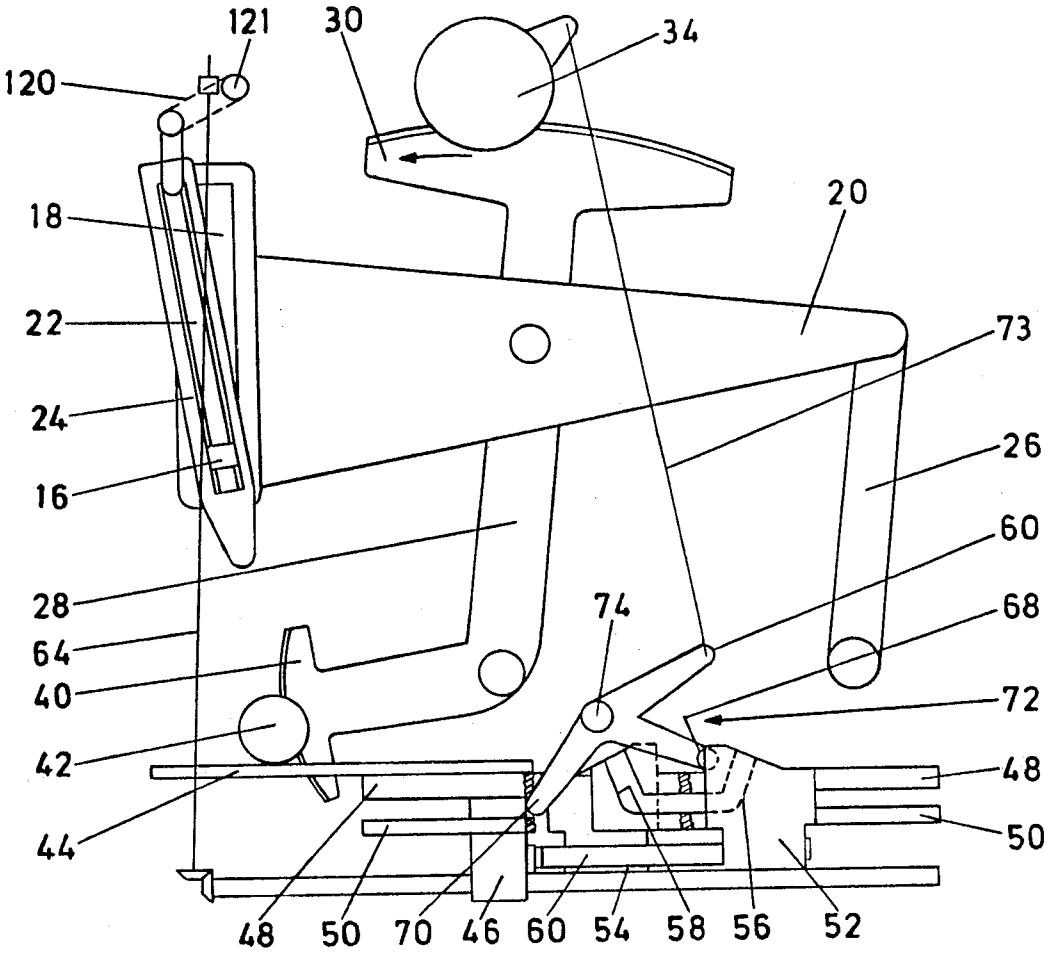
FIG. 4 shows schematically a side view of the principal parts of another variable draw mechanism for a straight bar knitting machine according to the invention in a first operative condition.
Figures 5, 11:
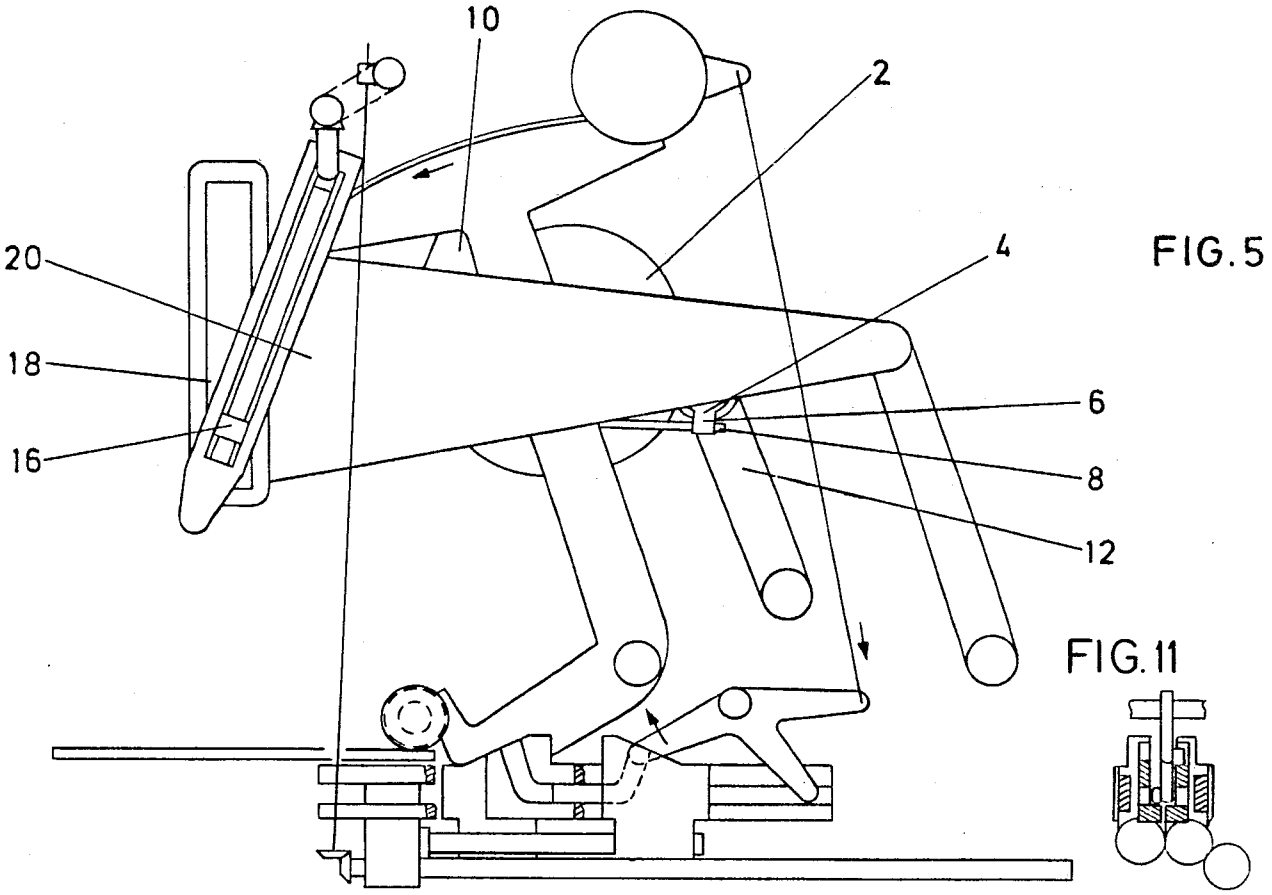
FIGS. 5,6,7,8,9 show other operating conditions.
FIGS. 11 and 12 show the position of a lead control cam follower in FIGS. 5 and 6 respectively.
Figures 6, 12:
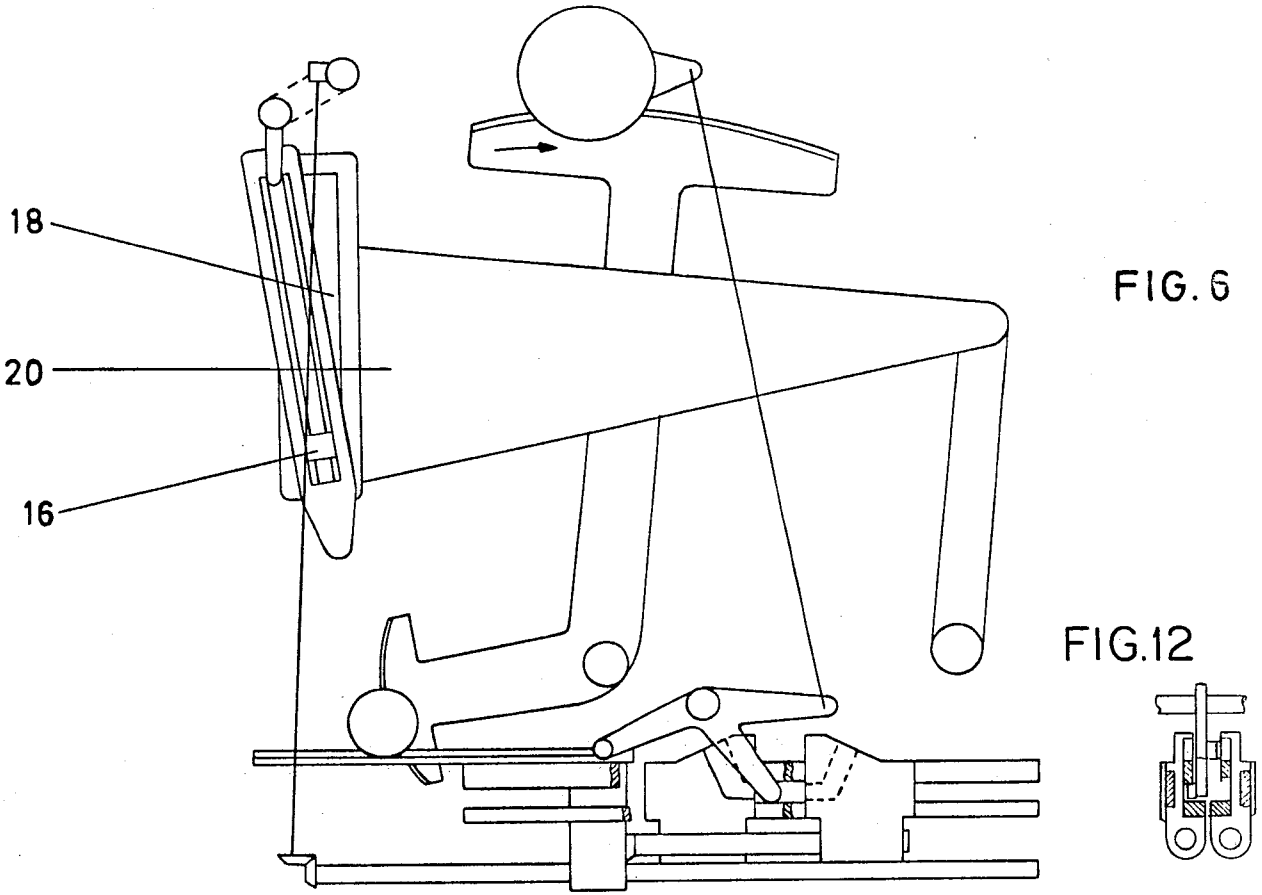
Figure 7:
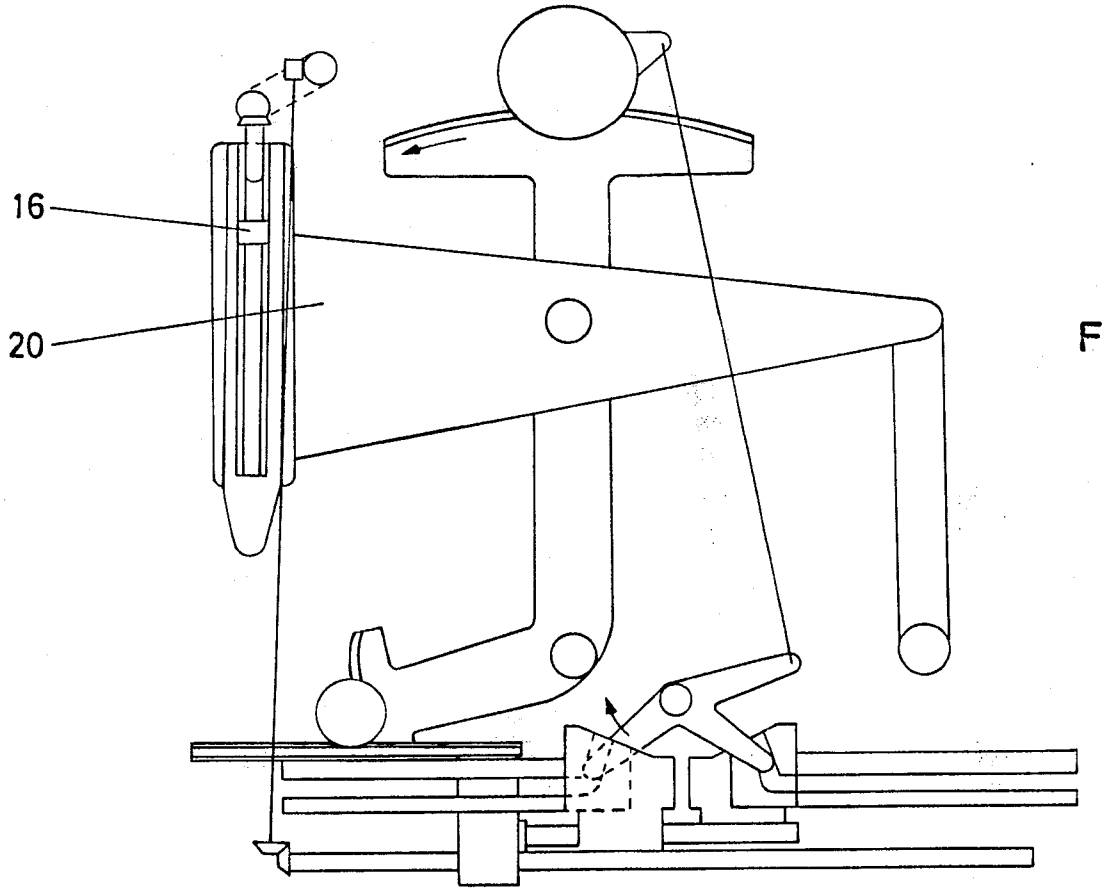
Figure 8:
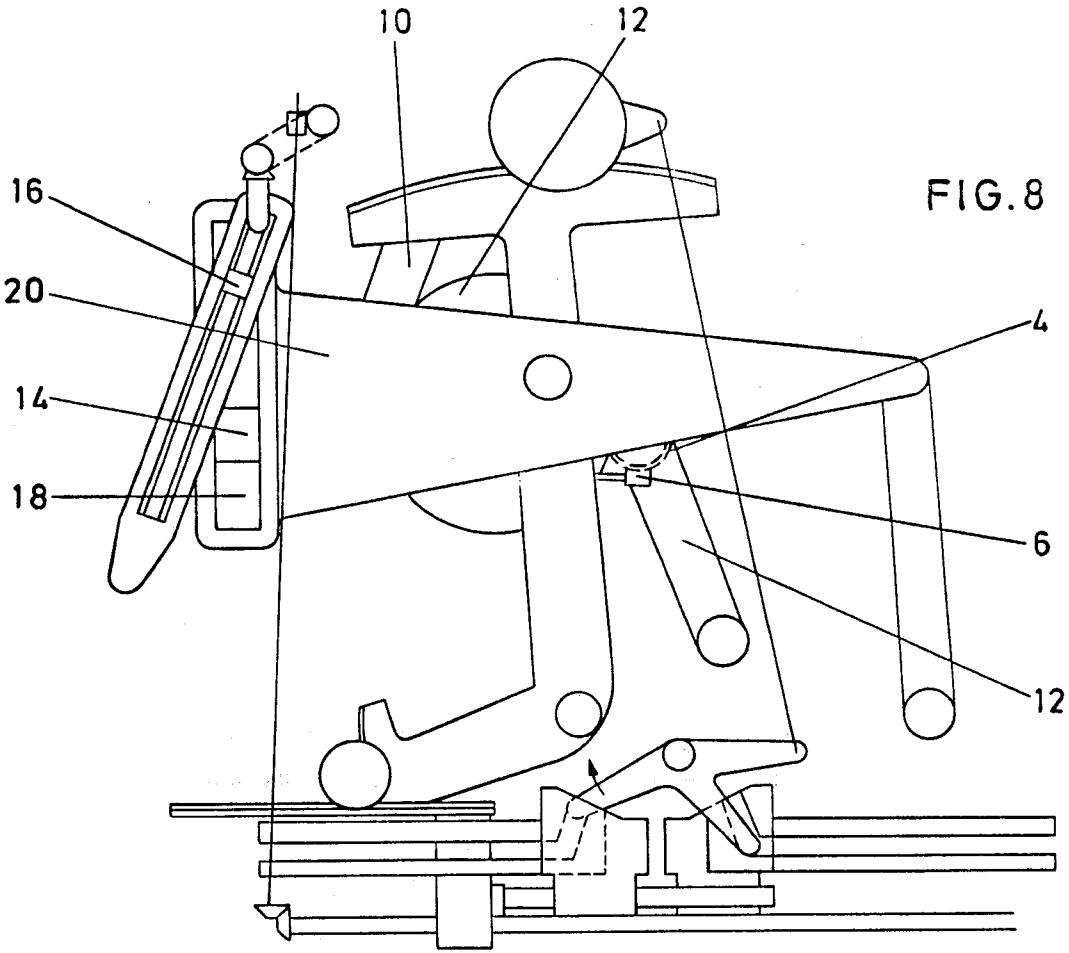
Figure 9:
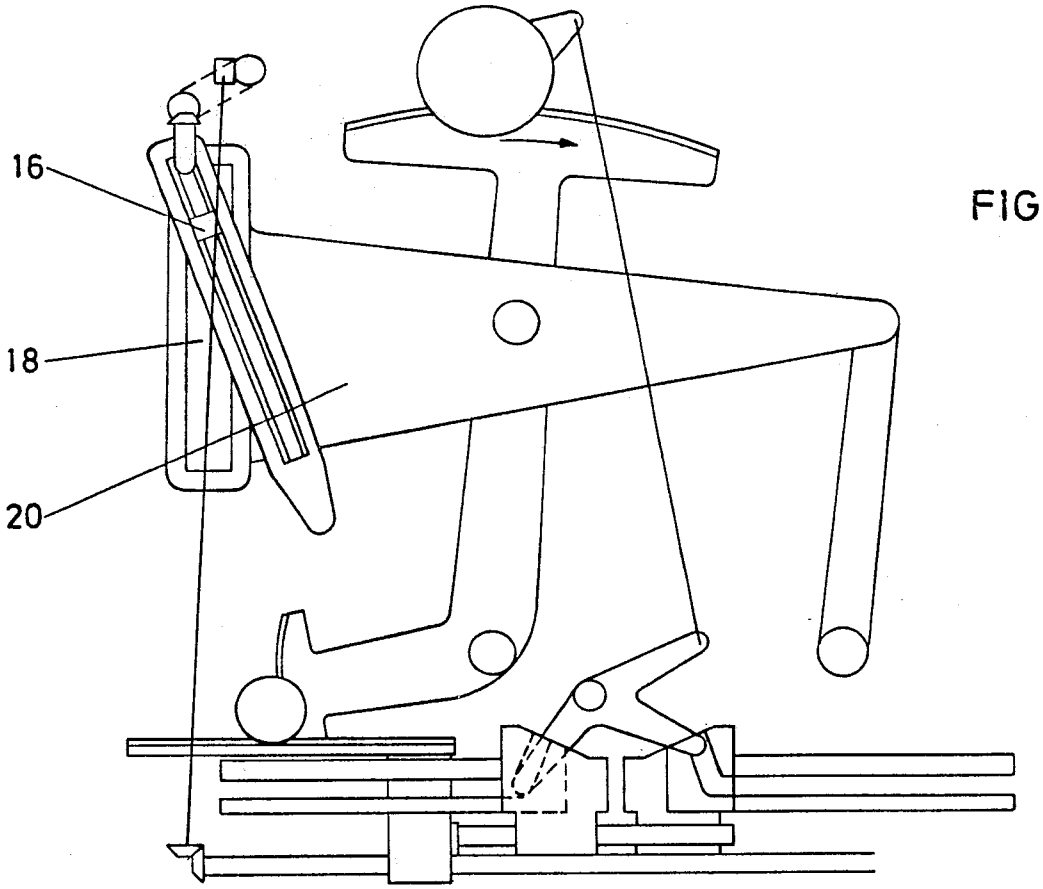

The complete sequence of events to control the draw motion is described with reference to FIGS. 4 to 9. FIGS. 4,5 and 6 show successive stages during a wide draw motion and FIGS. 7,8 9 show successive stages during a narrow draw motion. For a wide draw motion, the screw 22 and screws 60 and 62 are rotated simultaneously with the screw 121 mounting the end stop 104 for the carrier 106 using a chain 120 and a rotating shaft 124 having a gear 126 meshing with a gear on the screw 121 (see FIG. 10) to cause the end stops 104, the block 16 and the blocks 52 and 54 to occupy the positions appropriate for that particular draw motion. The block 16 is placed in a low position in the slot by screw 22. The rearmost block 54 is spaced to the left of the foremost block 52 by the screws 60 and 62.

Starting at the active part of the draw cycle (FIG. 4), the quadrant is pivoted, rotating a gear 108 of the differential 110. That gear 108 is directly connected by a shaft 112 and belt 114 to a slurcock 116. The roller 68 of the lead control cam follower lever 72 is located between the upper and low track bars 48 and 50 and held there by the action of cam 102 and the rod 103. The angular position of the lever 72 is connected by the rod 73 to control a pinion carrier 115 of the differential 110 and holds it in position so causing the carrier 106 to travel in the same direction as the slurcock by means of a belt and pulley drive transmission, at the same speed but with a given "lead" ahead of the slurcock (see FIG. 10). As the quadrant swing continues, the gear segment 40 moves the cam mounting causing the track bars 48 and 50 to slide past the roller 68, without moving the lever 72. In FIGS. 4,5 and 6 part of the front track bars 48 and 50 is broken away to show the parts lying behind.

Next (FIG. 5) the cam surface 56 approaches the roller 68 as the carrier 106 approaches the end stop 104. Just as the carrier 106 hits the end stop 104, the roller 68 and cam surface 56 cause the lever 72 to rock. The pinion carrier 114 is pivoted so countering the still continuing movement of the gear 108 which propels the slurcock 116. (See FIG. 5). When the roller 68 has climbed up the cam surface 56, the slurcock has overtaken the carrier 106 which is pressed against the stop 104. The cam surface 56 thus decelerates the carrier 106 as it hits the stop 104, locating the carrier 106 properly for selvedge formation. It also ensures that the carrier 106 will once more travel in advance of the slurcock 116 during the subsequent traverse. During the movement described the lever 72 occupies the attitude with respect to the cam mounting 46 illustrated in FIG. 11.

As the roller 68 is raised, the roller 70 is lowered between the different track bars.

The draw cycle ends at this stage. A knitting cycle takes place during which quadrant 30 remains stationary and the carrier and slurcock are not moved. The shogging cam 102 operates the rod 103 and shifts the lever 72 on its pivot axis. The roller 70 enters between its upper and lower track bars 48 and 50 whilst the roller 68 is pulled out of the path of the component forming the cam surface 56 as shown in FIG. 12.

FIG. 6 illustrates a stage of the draw movement in a reverse direction following the end of the knitting cycle. At the end of this draw movement, the rearmost cam surface 58 will rock the lever 72 and restore the differential to the condition illustrated in FIG. 4, ready to repeat the cycle.

For a narrower draw motion the screw 22 and screw 60 and 62 are rotated simultaneously with the end stop 104 so that the block 16 is in a higher position and the rearmost block 54 is moved oppositely to the foremost block 52. The time during which the lever 72 is held steady by the track bars will shorten gradually. FIGS. 7, 8 and 9 illustrate successive stages for a very narrow draw motion in which the differential 110 retards the yarn carrier during virtually all of the short draw motion. Naturally, the draw width varies gradually during knitting of a garment panel. FIGS. 4,5 and 6 and 7,8 and 9 show extreme positions.

In FIG. 7, the quadrant 30 is rocking clockwise for a narrow draw motion and is shown midway in its swing. At this stage the lever 72 is rocked by the action of the cam surface 56 on the roller 68 with the roller 70 being lowered. The carrier 106 is thus slowed down for most of the draw cycle.

In FIG. 8, the roller 68 has been fully raised as the quadrant 30 reaches the end of its movement. The slurcock has now travelled ahead of the carrier 106 to restore the lead. It can be seen that the roller 70 is ready to be raised by the ramp when the lever 72 has been moved axially during the next knitting cycle.

During the next draw cycle the slurcock will travel across but almost from the start the carrier will be halted by the rocking of the lever 72. The slurcock thus catches up with the carrier as it is pushed against the end stop and then overtakes it to restore the lead ready for the next traverse. The final position is shown in FIG. 9 with the roller 70 lifted by the cam surface 58. It can be seen that although the draw width is reduced, the cam surfaces 56 and 58 are relocated on the mounting so as to still engage the follower lever 72 at the end of the reduced draw motion.

The action is positive and can be obtained with simple cam forms.

The overall configuration has the effect that for a narrow width the carrier is slowed down earlier. This is in keeping with the imminent slow down of the slurcock.

In so doing the slowdown is spread over a greater arc of cam shaft rotation because the rollers 68, 70 have to climb the cam slopes using motion derived from the quadrant motion which has undergone a reducing effect in the transmission. Thus the required carrier deceleration characteristics can be preserved even if higher speeds of cam shaft rotation are employed for narrow widths so as to maintain the linear carrier speed unchanged.

We claim:

1. Straight bar knitting machine having a variable draw mechanism and a slurcock and yarn carrier movable to and fro by the draw mechanism, said draw mechanism including:

a gear arrangement having a differential drivingly connected to the slurcock and the carrier, a draw cam, draw cam follower means, a first input member drivingly connected to the gear arrangement, means for varying the ratio of transmission of the draw cam follower movement to the first input member to thereby vary draw width and transmission ratio control means therefor;

a second input member drivingly connected to the gear arrangement, said differential combining inputs of the first and second input member to differentiate slurcock and yarn carrier movement;

control means for the second input member having a cam mounting, means for moving said mounting conjointly with the first input member, lead control cam means on the mounting for bodily movement therewith, means for moving said lead control cam means individually with respect to said mounting conjointly with operation of said transmission ratio control means and lead control cam follower means drivingly connected to the second input member to retard the carrier and establish a desired carrier lead for a subsequent draw movement at varying draw widths.

2. Machine as claimed in claim 1 wherein the first input member is a pivotable draw lever having a first gear segment drivingly connected to the gear arrangement and having a second gear segment, said cam mounting supporting a rack for linear movement operable by the second gear segment.

3. Machine as calimed in claim 1 wherein the mounting supports a pair of rotatable screws and the lead control cam means are mounted for individual lengthwise movement on the screws when the screws are rotated.

4. Machine as claimed in claim 3 wherein splined shaft means are slidably engaged with the rotatable screws for simultaneous movement of the lead control cam means in opposite directions and the splined shaft means are operable by a driving connection to said transmission ratio control means.

5. Machine as claimed in claim 1 wherein the transmission ratio control means includes a pendulum lever, a screw rotatably journalled in the lever, a block mounted for individual lengthwise movement on the screw and the variable ratio transmission includes reciprocable member having a slot for driving engagement with the block, a pair of parallel arms carrying the reciprocable member drivingly connected to the first input member, and a link connected to the draw cam follower means and the block so that by rotating the screw the block occupies different positions in the slot to vary the ratio with which movement is transmitted from the draw cam follower means to the first input member.

6. Machine as claimed in claim 1 wherein the control cam follower means includes a lever, a shaft supporting the lever for pivotal movement on engagement of appropriate cam faces formed by the lead control cam means, and change-over means for moving the lever axially on the shaft operable in timed relationship to rotation of the draw cam means to move the lever into the path of an appropriate one of the cam means.

7. Machine as claimed in claim 6 wherein the lever has a pair of arms one for engaging each cam face and tracking means are provided to define a straight line track for each arm before it engages its respective cam face so as to hold the second input member in position until the draw movement approaches its ends.

* * * * *